US005810073A

United States Patent [19]

Holdt et al.

[11] Patent Number: 5,810,073

[45] Date of Patent: Sep. 22, 1998

[54] SCRAPING HEAT EXCHANGER

[75] Inventors: Peter von Holdt, Gross Grönau; Thomas Niemann, Breitenfelde, both of Germany

[73] Assignee: Schröder GmbH & Co. KG, Lübeck, Germany

[21] Appl. No.: 594,133

[22] Filed: Jan. 31, 1996

[30] Foreign Application Priority Data

Feb. 15, 1995 [EP] European Pat. Off. ..... 95102078.3

[51] Int. Cl.[6] ..... F28G 3/10

[52] U.S. Cl. ..... 165/94; 366/312

[58] Field of Search ..... 165/91, 94; 62/354; 15/256.5, 256.51; 366/67, 312, 313, 309, 311

[56] References Cited

U.S. PATENT DOCUMENTS

| | | | |
|---|---|---|---|
| 1,692,963 | 11/1928 | Thompson | 366/309 X |
| 1,698,402 | 1/1929 | Harris . | |
| 2,181,078 | 11/1939 | Dehuff | 366/309 |
| 2,289,613 | 7/1942 | Weinreich | 366/309 X |
| 2,867,994 | 1/1959 | Wakeman . | |
| 2,987,748 | 6/1961 | Scott | 15/256.51 |
| 4,151,792 | 5/1979 | Nearhood | 366/312 X |
| 4,192,615 | 3/1980 | Fortunski et al. | 366/312 X |
| 4,515,483 | 5/1985 | Múller et al. | 366/312 X |
| 5,485,880 | 1/1996 | Zeuthen | 165/94 |

FOREIGN PATENT DOCUMENTS

| | | | |
|---|---|---|---|
| 0036727 | 9/1981 | European Pat. Off. . | |
| 579365 | 7/1958 | Italy | 165/94 |
| 653562 | 1/1948 | United Kingdom . | |

*Primary Examiner*—Leonard R. Leo
*Attorney, Agent, or Firm*—Friedrich Kueffner

[57] ABSTRACT

A scraping heat exchanger for continuously heating or cooling viscous or highly viscous substances, particularly shortenings, includes a product cylinder which is surrounded by the heat carrier medium and a rotatably driven shaft mounted in the product cylinder. Together with the product cylinder, the shaft forms an annular gap for receiving the substance to be treated. Elongated scraping blades are attached to the shaft, wherein each blade has a cutting edge at the leading side in the direction of rotation and fastening webs at the trailing side. The scraping blades have comb-like teeth in the space behind the edge and between the fastening webs.

3 Claims, 1 Drawing Sheet

SCRAPING HEAT EXCHANGER

BACKGROUND OF THE INVENTION

1. Field of the Invention

The present invention relates to a scraping heat exchanger for continuously heating or cooling viscous or highly viscous substances, particularly shortenings. The heat exchanger includes a product cylinder which is surrounded by the heat carrier medium and a rotatably driven shaft mounted in the product cylinder. Together with the product cylinder, the shaft forms an annular gap for receiving the substance to be treated. Elongated scraping blades are attached to the shaft, wherein each blade has a cutting edge at the leading side in the direction of rotation and fastening webs at the trailing side.

2. Description of the Related Art

Scraping heat exchangers of the above-described type are known in the art. The edges of the scraping blades extend essentially parallel to the axis of the shaft to which they are attached. The blades continuously scrape the product from the inner cylinder wall and prevent the product from sticking to or burning at the inner wall of the cylinder.

The product cylinder is surrounded by a cylindrical wall in which the heat carrier medium for heating or cooling the product either flows, in the case of, for example, cooling water, ice water, hot water, or condenses in the case steam or is vaporized in the case of ammonia or freon.

In the case of a predetermined constant throughput quantity (liters/hours), the dwell time of the product in the scraping heat exchanger is determined by the size of the annular gap between the cylinder and the shaft. The throughput quantity is determined by the following influences:

1. Viscosity and structure of the product
2. Axial flow velocity of the product (can generally be disregarded because the flow is usually creeping, except in the case of very small gaps between the blade shaft and the cylinder, in which case $\alpha_1$ is influenced).
3. Scraping frequency of the product from the cylinder wall, i.e., 1. rate of rotation of the shaft (revolutions per minute) proportional to the blade speed;
2. number of blades or blade rows on the periphery of the shaft. In addition, a mechanical energy input occurs over the entire length of the cylinder/blade shaft which dissipates additional heat when heated, while this heat must be discharged in the case of cooling processes through the cylinder surface. When the dwell time of the product at the cooling surface is too short, i.e., there are too many rows of blades or the rate of rotation of the blade shaft is too high, there is insufficient time for cooling of the product on the cooling surface, so that the temperature difference between the core product and the product scraped from the cooling surface is too small and, thus, only an insignificant cooling of the core product takes place.

4. Arrangement and geometric configuration of the blades (either individual blades or blades arranged in closed rows are provided and the blades are mounted tangentially and radially relative to the blade shaft).
5. Wall thickness of the cylinder (the wall thickness should be as thin as possible, however, the wall thickness is dictated by the internal pressure of the product, the pressure of the heat carrier medium and the manufacturing capabilities).
6. Material of the cylinder.
7. Heat transfer from the cylinder wall to the heat carrier medium.

Known scraping blades are relatively elongated; for example, they have a length of 200 mm. The edge of each blade is located on the leading side in the direction of rotation; during operation, this edge slides along the inner wall surface of the product cylinder. On the trailing sides of the blades are provided fastening webs with openings for fastening the blades by means of bolts, screws and/or pens. In the known scraping blades, intermediate spaces are provided between the fastening webs or the fastening webs are omitted entirely.

The heat exchange is always disadvantageously influenced when the effective temperature difference between the wall temperature and the respective product temperature is reduced as the product travels through the cylinder. Assuming that the temperature of the heat carrier medium (vapor or ammonia/freon) is constant over the entire length of the product cylinder, the temperature difference between product and carrier medium is continuously decreased as a result of the heating/cooling of the product and, thus, the product temperature and the carrier medium temperature approach each other toward the outlet of the heat exchanger. Consequently, the heat transfer value decreases continuously.

In addition, due to the tangential arrangement of the blades and the low turbulence in the gap, the high product viscosity causes the scraped and either heated or cooled product to be conducted back against the heat transfer wall directly following the blade, so that a resulting lower temperature difference reduces the heat exchange between the product and the cylinder wall.

Of course, an increase of the circumferential speed of the blade shaft increases the frequency with which the blade scrapes and, simultaneously, the turbulence in the annular space is increased. However, the electrical/mechanical energy input into the product negatively influences cooling processes because this heat input must be discharged through the cooling surface. In addition, the installed drive power must be increased which leads to increased running operating costs and to increased wear of the blades and of the inner wall surface of the cylinder.

Also, when the number of blades remains the same and the rate of rotation is increased, the drive power at the shaft is increased approximately in the third power depending on the type and viscosity of the product.

Accordingly, for increasing the scraping frequency, the number of rows of blades on the shaft should be increased while the rate of rotation remains the same. This does lead to increased mechanical wear of the inner wall surface of the cylinder; however, a linear increase of the rows of blades leads only to a proportional increase of the drive power and, thus, of the heat dissipated into the product.

In the case of flow velocities of 0.1 to 10 cm/s, the axial flow of the viscous product in the annular space results in small Reynolds' numbers and, consequently, in a laminar flow and, in the case of large gaps between cylinder and blade shaft, even in a creeping flow (the inertia forces being substantially smaller than the viscousness forces), i.e., any movement is started spontaneously with the energy input and the movement stops immediately after the energy input is terminated. Secondary flows as a result of inertia forces do not occur. Also, movements transverse of the mechanically initiated forces and force directions do not exist.

Depending on the product, the desired energy input and the viscosity, the radial speeds imparted by the rate of rotation of the blade shaft is 0.5–5 m/s at the blade edge. Consequently, compared to the axial flow influences, the radially acting mechanical influences are significantly more important for the heat transfer from the product to the inner wall of the cylinder.

In the case of viscous products, as they are processed in scraping heat exchangers, the heat transfer from the product to the inner wall of the cylinder takes place in laminar flow conditions. Turbulent flows are only reached in the case of low viscosities of 10–200 cp, depending on the rate of rotation of the blade shaft.

SUMMARY OF THE INVENTION

Therefore, it is primary object of the present invention to provide a scraping heat exchanger of the type described above in which, compared to known scraping heat exchangers, the output is increased, i.e., the efficiency is significantly improved, while all other parameters are the same.

In accordance with the present invention, the scraping blades have comb-like teeth in the space behind the edge and between the fastening webs.

In the scraping heat exchanger according to the present invention, the newly developed scraping blades produce Taylor whirls in the annular space in addition to the radial and axial flow conditions and improve the heat transfer. As a result, the product particles scraped from the cold inner wall of the cylinder are better mixed with the warmer product particles in the annular space and, thus, the temperature difference between the cold and warm product particles is better utilized.

Taylor whirls are oppositely rotating whirls which occur in pairs and which are superimposed upon the axial basic flow and are produced in annular spaces of certain sizes and in the case of certain axial or radial flow velocities. The blades according to the present invention produce these whirls behind the narrow intermediate spaces or slots and help to improve the exchange between hot and cold products in the annular space between the blade shaft and the cylinder (in cooling processes, between the warm and colder product) and, thus, to increase the heat removal from the product.

In addition, the barrier layer of the product at the cooling surface is continuously destroyed by the blades and, consequently, the already cooled product is very quickly and intensively mixed with the substantially warmer core flow.

In the case of highly viscous products, the rate of rotation of the blade shaft is to be increased proportionally, in order to achieve a uniform temperature distribution in the annular space, even if the higher rate of rotation results in a greater energy dissipation in the product and, consequently, this energy must be removed additionally through the surface in the case of cooling processes.

Especially, in the case of highly viscous products, the blades according to the present invention make it possible to keep the rate of rotation of the blade shaft low, so that the entire heat exchange is positively influenced. In addition, the product leaves the scraping heat exchanger more uniformly cooled than in heat exchangers with known blades, particularly when the rates of rotation are low.

In addition to the improvement in the heat transfer in the scraping heat exchanger with the novel scraping blades, it was possible to achieve in cooling and crystallizing shortening (nutrient fat with 5–25% nitrogen incorporated therein) an improvement of the fine distribution of the nitrogen (smaller gas bubbles) and, thus, the desired brighter white of the product. In addition, the structure of the final product was improved (improved plasticity) by the intensive processing of the product.

In a production plant for manufacturing shortening, the following data were achieved when using the known shape of blades:

Shortening having a fat characteristic of 20% fat crystals (SFI=solid fat index) at 20° C. and 0% crystals at 45° C. and a viscosity of about 60 cp at 50° C. and 10,000 cp at 20° C. was continuously cooled with direct ammonia vaporization (−20° C.) in a scraping heat exchanger from 60° C. to 25° C. with an output or production of 4,000 kg/h and was subsequently aftertreated in a crystallizer (PIN-worker).

When using a scraping heat exchanger with the blades according to the present invention, an output or production of 4,440 kg/h could be achieved with the same product and same parameters, which corresponds to an improvement of the heat transfer of about 11%. In addition, the gas distribution and the plasticity of the final product were improved.

Overall, this means that the production of existing plants can be increased depending on the product by about 10% while all other parameters are the same. When designing new plants, this improvement leads to a decrease in the investment costs for machinery.

The above-described improvements of the heat transfer from the product to the heat carrier medium when using the blades according to the present invention are, of course, applicable to heating processes in the scraping heat exchanger.

In accordance with another feature of the present invention, the width between the comb-like teeth corresponds approximately to the width of the teeth.

In accordance with a further feature, the distance between the fastening openings in the fastening webs of the blades is about 50 mm and three teeth and four spaces between the teeth each having a width of about 6 mm and a depth of about 20 mm are provided.

In accordance with a further development of the present invention, the spaces between the teeth are bridged at the ends thereof by narrow connecting webs 15 shown in FIG 3. This feature not only improves the structure of the scraping blades, but additionally advantageously influences the heat transfer.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
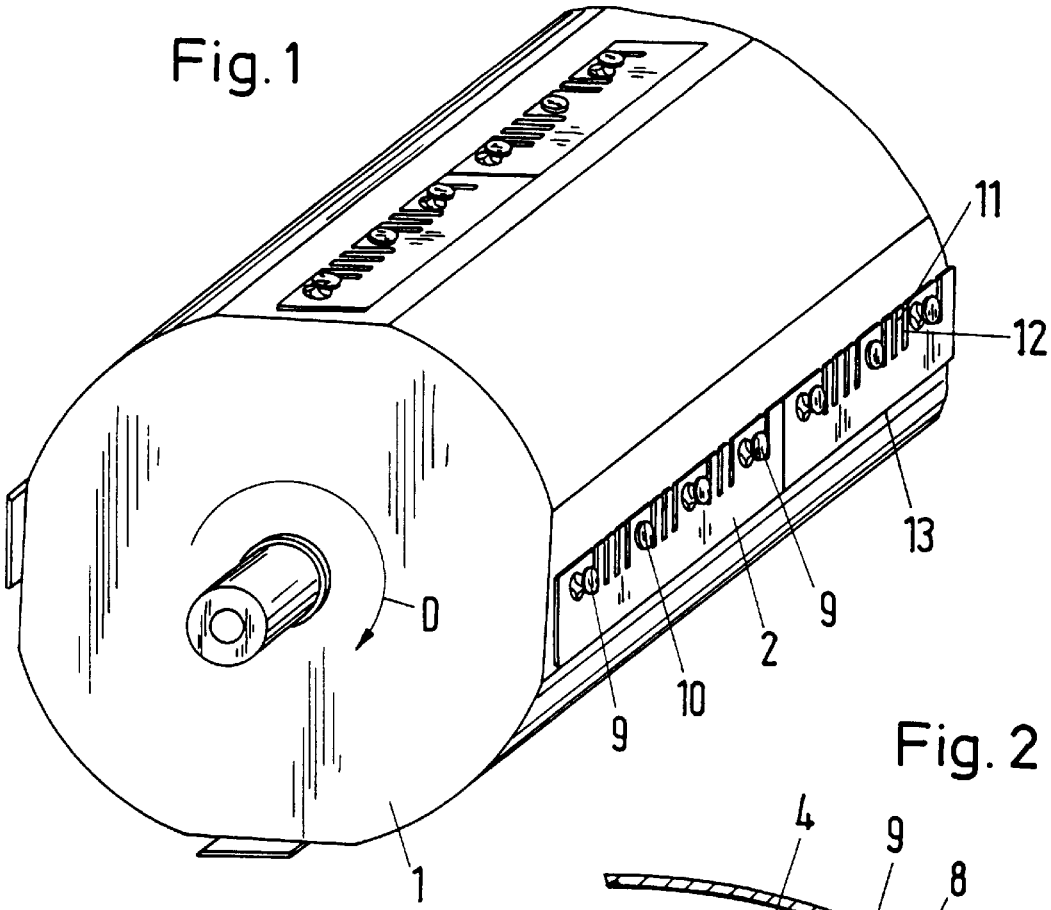
FIG. 1 is a perspective front view of a portion of a shaft to be mounted in a product cylinder of a scraping heat exchanger according to the present invention.
Figure 2:
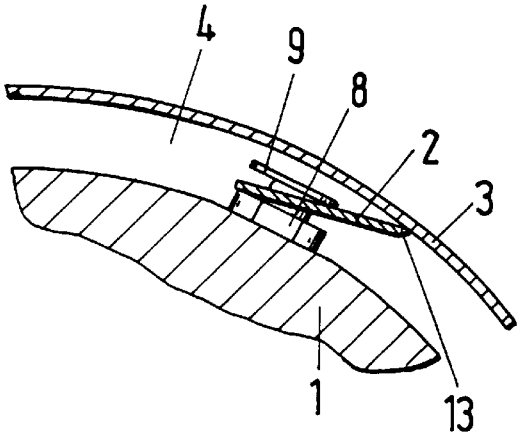
FIG. 2 is a partial sectional view, on a larger scale, showing the area of the annular gap of the scraping heat exchanger according to the present invention.

The scraping heat exchanger illustrated in the drawing includes a product cylinder 3 which is surrounded by the heat carrier medium which may be used for heating or cooling. The shaft 1 illustrated in FIG. 1 is rotatably mounted in the product cylinder 3 and is driven in the direction of arrow D.

A plurality of scraping blades 2 are mounted on the circumference of the shaft in such a way that they are "loose" in radial direction, i.e., the scraping blades 2 are movable in radial direction to a limited extent.

The scraping blades 2 have fastening webs 14 and fastening holes 5 and 7 are provided in the fastening webs 14. The fastening holes 5 are oblong holes, while the fastening hole 7 has a circular cross section. For fastening the scraping blade 2, the oblong holes 5 are slid with the opening portions 6 having the greater diameter over the heads 9 of bolts 8 and are then displaced slightly parallel to the axial direction of the shaft 1 until the portions 8 of the bolts are in the narrower portions of the oblong holes 5. A screw 9 is then screwed through the fastening hole 7, so that a movement of the bolt 8 back into the area of the opening portion 6 is prevented, while the desired radial movement is still possible. This radial movement is always sufficient for allowing the edges 13 of the scraping blades to make contact with and scrape at the inner wall surface of the product cylinder 3.

Comb-like teeth 11 with intermediate spaces 12 are provided between the fastening webs 14. These teeth 11 act on the substance to be treated in the manner described above, i.e., they influence the flow conditions in such a way that the efficiency of the scraping heat exchanger is significantly improved.

Figure 3:
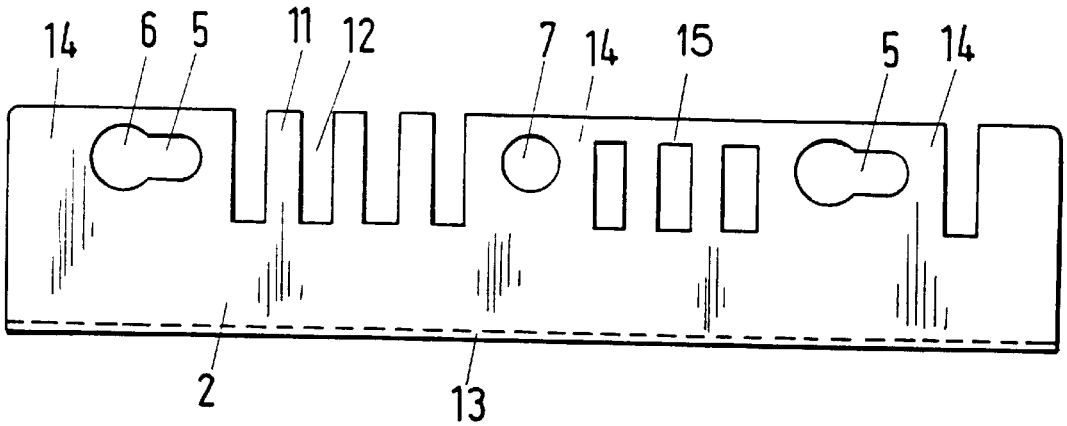
FIG. 3 is a top view, on an even larger scale, of an embodiment of a scraping blade according to the present invention.

It is apparent that the invention is not limited to the embodiment illustrated especially in FIG. 3. Rather, other types of teeth or lugs are conceivable which are arranged in the direction of rotation behind the edges and operate in the manner described in detail above.

In an embodiment which has proved successful in practice, the scraping blades had a length of about 190 mm. The width of each scraping blade including the fastening portions and the teeth was 40 mm. The depth of the intermediate spaces and, thus, the length of the teeth, was 20 mm. Each tooth and each intermediate space had a width of 6 mm. Two outer fastening holes shaped as oblong holes and a fastening hole in the middle with a circular cross section were provided. In total, the blade had five teeth and six intermediate spaces.

Of course, the invention is not limited to these dimensions and shapes. The above dimensions and shapes merely represent an example in order to better describe the invention.

For example, in accordance with a possible modification, connecting webs are provided at the ends of the teeth, wherein the connecting webs additionally act on the substance to be treated and simultaneously stabilize the scraping blade.

While specific embodiments of the invention have been shown and described in detail to illustrate the inventive principles, it will be understood that the invention may be embodied otherwise without departing from such principles.

We claim:

1. A scraping heat exchanger for continuously heating or cooling viscous or highly viscous substances, the scraping heat exchanger comprising a product cylinder surrounded by a heat carrier medium, a rotatably driven shaft having an axis and a length being mounted in the product cylinder such that an annular gap is formed for receiving the substance to be treated between the product cylinder and the shaft, at least one elongated scraping blade being attached to the shaft, the blade extending in axial direction over the length of the shaft, the blade having a leading scraping edge in contact with the product cylinder and a trailing edge in a direction of rotation, the at least one scraping blade comprising fastening webs spaced from the scraping edge, the at least one scraping blade further comprising comb-like teeth located in the blade between the fastening webs in an area behind the scraping edge, and narrow connecting webs bridging the intermediate spaces between the teeth.

2. The scraping heat exchanger according to claim 1, wherein intermediate spaces are defined between the teeth, and wherein the intermediate spaces and the teeth each have a width, the width of the intermediate spaces and the teeth being approximately equal.

3. The scraping heat exchanger according to claim 2, wherein the fastening webs have fastening openings, the fastening openings being spaced apart by a distance of about 50 mm, and wherein three teeth and four intermediate spaces each having a width of about 6 mm and a depth of about 20 mm are provided between the fastening openings.

* * * * *